US012279687B1

(12) United States Patent
Pennington

(10) Patent No.: US 12,279,687 B1
(45) Date of Patent: Apr. 22, 2025

(54) LOW PROFILE WIG HANDLING SYSTEM

(71) Applicant: Veda Pennington, Hoffman Estates, IL (US)

(72) Inventor: Veda Pennington, Hoffman Estates, IL (US)

( * ) Notice: Subject to any disclaimer, the term of this patent is extended or adjusted under 35 U.S.C. 154(b) by 77 days.

(21) Appl. No.: 18/093,366

(22) Filed: Jan. 5, 2023

Related U.S. Application Data

(60) Provisional application No. 63/296,559, filed on Jan. 5, 2022.

(51) Int. Cl.
*A45D 44/14* (2006.01)
*A47F 7/06* (2006.01)

(52) U.S. Cl.
CPC ..... *A45D 44/14* (2013.01); *A47F 7/065* (2013.01)

(58) Field of Classification Search
CPC ..... A45D 44/14; A47F 7/065
See application file for complete search history.

(56) References Cited

U.S. PATENT DOCUMENTS

| | | | | |
|---|---|---|---|---|
| 3,289,822 A | | 12/1966 | Schumer et al. | |
| 3,289,823 A | | 12/1966 | Weiser | |
| 3,310,162 A | | 3/1967 | Bayer | |
| 3,310,267 A | | 3/1967 | Koehler | |
| 3,342,478 A | * | 9/1967 | Shaw | A45D 44/14 223/66 |
| 3,462,050 A | * | 8/1969 | Hensley | A45D 44/14 223/66 |
| 3,498,510 A | * | 3/1970 | Johnson | A45D 44/14 223/66 |
| 3,568,899 A | | 3/1971 | Rosenberg | |
| 3,587,836 A | | 6/1971 | Brown | |
| 3,603,322 A | | 9/1971 | Wilson | |
| 3,658,174 A | | 4/1972 | Friedman | |
| 3,709,407 A | * | 1/1973 | Sanford | A45D 44/14 223/66 |
| 8,496,481 B2 | * | 7/2013 | Li | G09B 19/0076 434/94 |
| 9,609,931 B2 | | 4/2017 | Rosenblatt et al. | |
| 9,761,150 B2 | * | 9/2017 | Pang | G09B 19/00 |
| 10,117,486 B2 | * | 11/2018 | Cook | B65D 43/02 |
| 11,191,344 B1 | * | 12/2021 | Alexis | G09B 19/0076 |
| 2020/0281374 A1 | * | 9/2020 | Madueke | A45C 11/00 |
| 2021/0195983 A1 | * | 7/2021 | Thorn | A47F 5/10 |

FOREIGN PATENT DOCUMENTS

DE 4003821 A1 8/1991

* cited by examiner

*Primary Examiner* — F Griffin Hall
(74) *Attorney, Agent, or Firm* — John Rizvi; John Rizvi, P.A.—The Patent Professor®

(57) ABSTRACT

A low profile wig handling system to store, transport and prepare a plurality of wigs. A low profile wig assembly includes one or more low profile wig heads which are adjustable between a plurality of adjustable wig head configurations. A wig retainer on each low profile wig head retains a wig thereon. A frame assembly includes a central frame member and a support assembly has a support member operable with the central frame member to maintain the low profile wig head and a wig retained thereon in an operative upright orientation. A wig head adjustment assembly has one or more adjustment members to permit adjustment of a low profile wig head between a plurality of adjustable wig head configurations. A transport cover to receive a plurality of wigs retained on a corresponding low profile wig head therein.

20 Claims, 5 Drawing Sheets

LOW PROFILE WIG HANDLING SYSTEM

CROSS-REFERENCE TO RELATED APPLICATIONS

This application claims the benefit of U.S. Provisional Patent Application Ser. No. 63/296,559 filed on Jan. 5, 2022, which is incorporated by reference herein in its entirety.

FIELD OF THE INVENTION

The present invention relates generally to a low profile wig handling system allows a user to securely store, transport and prepare at least one wig.

BACKGROUND OF THE INVENTION

Most people are likely familiar with the traditional bulky, one size fits all STYROFOAM® or hard plastic wig heads which are used to store a wig while not in use, as well as to support a wig on a supporting surface while the wig is prepared, i.e., styled, prior to being worn by a person. Many people have likely seen such a traditional wig head being used to store a wig used by their mother, a sister or perhaps an aunt.

Of course, the one size fits all approach common to these type of traditional wig heads has a number of shortcomings. First of all, not all wigs are the same size, and for a custom wig that is specifically designed and fitted for a person having a smaller than average head size, storing such a custom wig on a traditional wig head can result in damage to the wig by stretching the cap or net onto which the wig hair is attached. It is well know that such custom wigs can easily cost in the range of hundreds of dollars or more, particularly if the wig is formed of human hair, and as such, use of a traditional wig head can result in significant and unnecessary expense as a result of damage to these expensive wigs.

Alternatively, if a wig is designed and fitted for a person having a larger than average head size, the wig may not be properly retained on such a traditional wig head, slipping off and possibly being damaged, as well as slipping and sliding about while one is attempting to style the wig prior to use.

In the case of the somewhat ubiquitous STYROFOAM® wig heads, they also present potential health risks from exposure to the styrene contained therein, as well as creating an environmental hazard as STYROFOAM® is not recyclable and is non-biodegradable. In fact, one study has shown that certain STYROFOAM® products may remain in the environment for up to 500 years or more before they decompose.

Another drawback to these traditional wig heads is that they are considerably bulky and require considerable space for storage, especially for persons having a number of different wigs, which is not uncommon. Each wig head having a wig attached are often stored in individual wig cases or boxes which, as noted above, can take up an even greater amount of space. Storing as few as 3 or 4 wigs on a traditional wig head in a wig case or box can easily take up the entire bottom floor space of a standard sized closet. In fact, persons having extensive wig collections may require a separate walk-in size closet, which itself involves considerable cost even if space is available for such a closet, simply to store their wigs in a manner which does not result in damage to the wigs themselves.

This matter is exacerbated when it comes to transporting wigs which are stored on a traditional wig head stored in a wig case or box because, once again, even a few wigs stored in this manner can take up considerable space. Further, if the wig case or box is not customized to fit a particular wig/wig head arrangement, the wig may shift around and become damaged or at least tussled requiring additional preparation prior to being worn once it arrives at its final destination. The problem is even worse when transporting wigs stored on a traditional wig head that are not in a wig case or box, as they are even more likely to shift around and risk potential damage, etc.

Accordingly, there is an established need for a solution to one or more of the aforementioned shortcomings in the current state of the art.

SUMMARY OF THE INVENTION

The present invention is directed to a low profile wig handling system allows a user to securely store, transport and prepare at least one wig.

In a first implementation of the invention, a low profile wig handling system allows a user to securely store, transport and prepare at least one wig having a predefined internal configuration comprises: a low profile wig assembly having at least one low profile wig head which is adjustable between a plurality of adjustable wig head configurations; a wig retainer disposed on an upper portion of the at least one low profile wig head is dimensioned and configured to retain the at least one wig thereon; the at least one low profile wig head comprising a frame assembly including a central frame member having a support member interconnect; the at least one low profile wig head further comprising a wig head adjustment assembly having at least one adjustment member to permit adjustment of the at least one low profile wig head between the plurality of adjustable wig head configurations; a support assembly having at least one support member operable with the central frame member maintains the at least one low profile wig head, and the at least one wig retained thereon, in an operative upright orientation; and a transport assembly comprising a transport cover dimensioned and configured to receive the plurality of wigs each securely retained on a corresponding one of the plurality of low profile wig heads therein.

In a second aspect, the low profile wig handling system can include at least one low profile wig head having a front portion and a rear portion.

In another aspect, the low profile wig handling system may have at least one low profile wig head including a face member mounted on a front portion thereof.

In a further aspect, the low profile wig handling system can include a wig retainer having a plurality of wig retention members.

In one other aspect, the low profile wig handling system may have a plurality of wig retention members arranged on a wig retainer in a wig retention array.

In yet another aspect, the low profile wig handling system can include a frame assembly having at least one side frame member mounted to a central frame member.

In still one further aspect, the low profile wig handling system may have a frame assembly including a plurality of side frame members mounted to a central frame member.

In yet one other aspect, the low profile wig handling system can include a plurality of side frame members having at least one inner side frame member and at least one outer side frame member.

In still another aspect, the low profile wig handling system may have at least one low profile wig head including a head encasement dimensioned and configured to be disposed over a frame assembly in a surrounding relation thereto.

In still one other aspect, the low profile wig handling system may have a wig head adjustment assembly including at least one adjustable wig head compartment attached adjacent one side of a frame assembly, the at least one adjustable wig head compartment dimensioned and configured to receive at least one adjustment member therein to permit adjustment of at least one low profile wig head to one of a plurality of adjustable wig head configurations which approximates a predefined internal configuration of at least one wig retained thereon.

In yet another aspect, the low profile wig handling system can include a wig head adjustment assembly having a plurality of adjustment members.

In still one further aspect, the low profile wig handling system may have a wig head adjustment assembly including a plurality of adjustable wig head compartments each attached adjacent an opposite side of a frame assembly, each of the plurality of adjustable wig head compartments dimensioned and configured to receive at least one of a plurality of adjustment members therein to permit adjustment of at least one low profile wig head to one of a plurality of adjustable wig head configurations which approximates a predefined internal configuration of at least one wig retained thereon.

In yet one other aspect, the low profile wig handling system can include a wig head adjustment assembly having a plurality of adjustable wig head compartments each attached adjacent an opposite side of a frame assembly, each of the plurality of adjustable wig head compartments dimensioned and configured to receive at least some of a plurality of adjustment members therein to permit adjustment of at least one low profile wig head to one of a plurality of adjustable wig head configurations which approximates a predefined internal configuration of at least one wig retained thereon.

In still another aspect, the low profile wig handling system may have a support member including a hanger member having a hook to facilitate supporting at least one low profile wig head having at least one wig retained thereon from an elevated member.

In yet one further aspect, the low profile wig handling system can include a support member having a stand member including a base to facilitate supporting at least one low profile wig head having at least one wig retained thereon on an underlying surface.

In a another implementation of the invention, a low profile wig handling system allows a user to securely store, transport and prepare at least one wig having a predefined internal configuration comprises: a low profile wig assembly having a plurality of low profile wig heads each adjustable between a plurality of adjustable wig head configurations; a wig retainer disposed on an upper portion of each of the plurality of low profile wig heads, each the wig retainer dimensioned and configured to retain at least one of the plurality of wigs thereon; each of the plurality of low profile wig heads comprising a frame assembly including a central frame member having a support member interconnect; each of the plurality of low profile wig heads further comprising a wig head adjustment assembly having a plurality of adjustment members and an adjustable wig head compartment attached adjacent opposite sides of the frame assembly, each of the plurality of adjustable wig head compartments dimensioned and configured to receive at least some of the plurality of adjustment members therein to permit adjustment of each of the plurality of low profile wig heads to one of the plurality of adjustable wig head configurations which approximates the predefined internal configuration of a corresponding one of the plurality of wigs retained thereon; a support assembly having at least one support member operable with the central frame member maintains the at least one low profile wig head, and the at least one wig retained thereon, in an operative upright orientation; and a transport assembly comprising a transport cover dimensioned and configured to receive the plurality of wigs each securely retained on a corresponding one of the plurality of low profile wig heads therein.

In a further implementation of the invention, a low profile wig handling system allows a user to securely store, transport and prepare at least one wig having a predefined internal configuration comprises: a low profile wig assembly having a plurality of low profile wig heads each adjustable between a plurality of adjustable wig head configurations; a wig retainer disposed on an upper portion of each of the plurality of low profile wig heads, each the wig retainer dimensioned and configured to retain at least one of the plurality of wigs thereon; each of the plurality of low profile wig heads comprising a frame assembly including a central frame member having a support member interconnect; each the frame assembly further comprising a plurality of side frame members mounted to the central frame member; each of the plurality of low profile wig heads further comprising a wig head adjustment assembly having a plurality of adjustment members including at least a primary adjustment member, a secondary adjustment member and a tertiary adjustment member, and an adjustable wig head compartment attached adjacent opposite sides of the frame assembly, each of the plurality of adjustable wig head compartments dimensioned and configured to receive at least some of the plurality of adjustment members therein to permit adjustment of each of the plurality of low profile wig heads to one of the plurality of adjustable wig head configurations which approximates the predefined internal configuration of a corresponding one of the plurality of wigs retained thereon; a support assembly having at least one support member operable with the central frame member maintains the at least one low profile wig head, and the at least one wig retained thereon, in an operative upright orientation; and a transport assembly comprising a transport cover dimensioned and configured to receive the plurality of wigs each securely retained on a corresponding one of the plurality of low profile wig heads therein.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower". "left", "rear", "right". "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a low profile wig handling system allows a user to securely store, transport and prepare at least one wig, as shown as at 100 throughout the figures.

Figure 1:
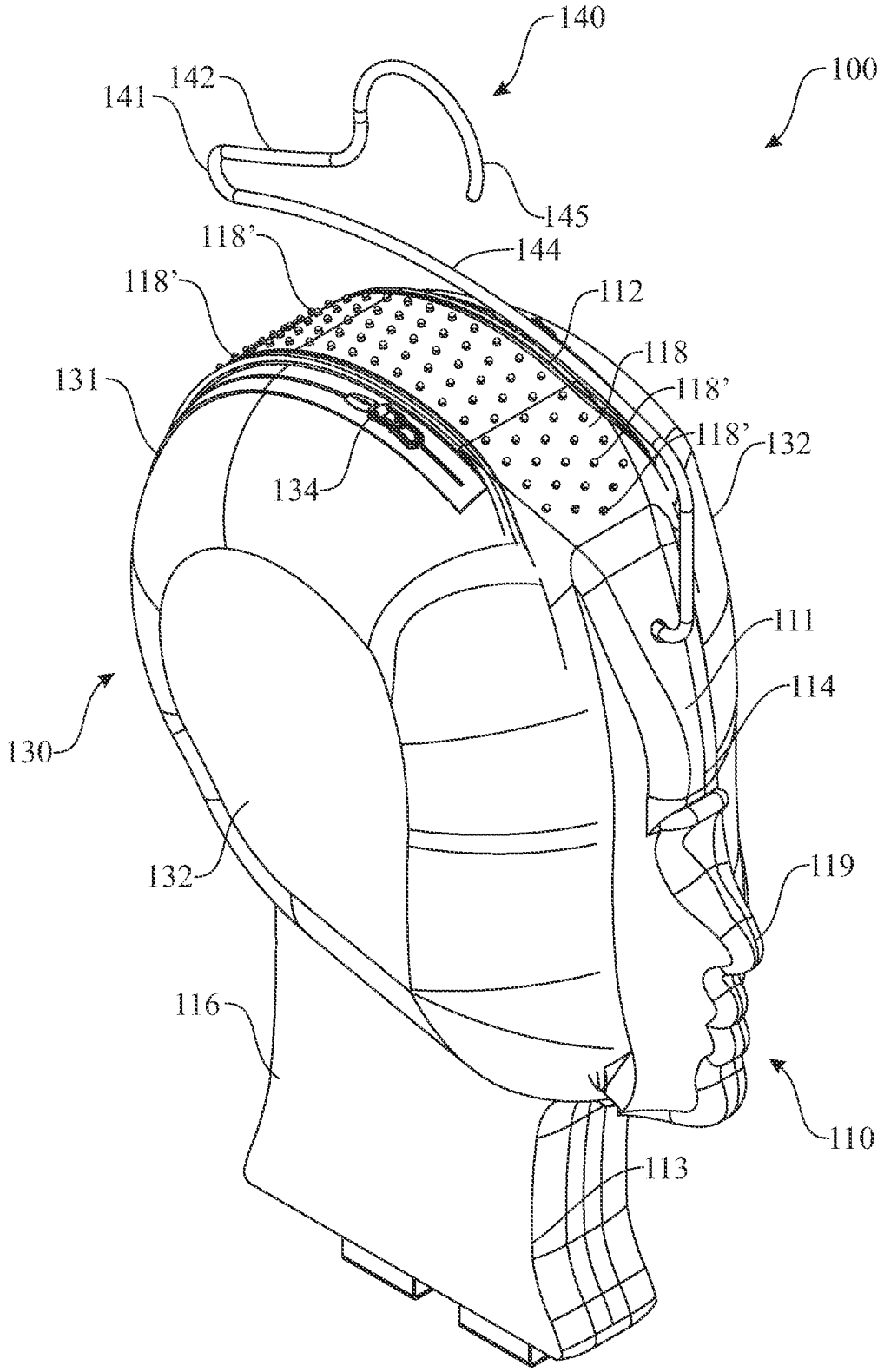
FIG. 1 presents a front perspective view of one illustrative embodiment of a low profile wig handling system, in accordance with the present invention.
Figure 2:
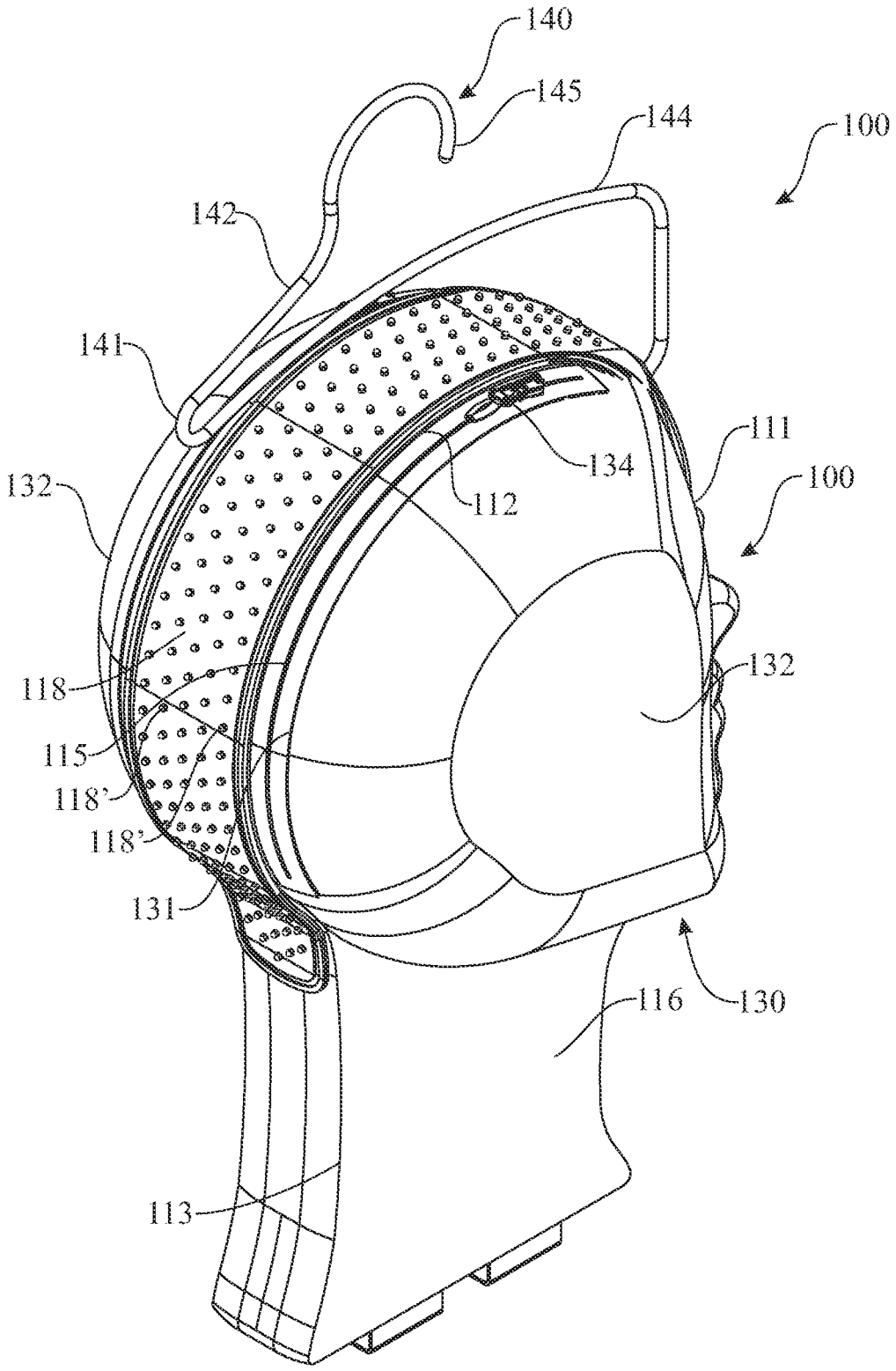
FIG. 2 presents a rear perspective of the low profile wig handling system of FIG. 1, in accordance with the present invention.

Referring initially to FIGS. 1 and 2, presented therein are front and rear perspective views, respectively, of one illustrative embodiment of a low profile wig handling system 100, in accordance with the present invention. As may be seen from the figures, a low profile wig handling system 100 includes a low profile wig head assembly 110 having at least one low profile wig head 111. In accordance with at least one embodiment of a low profile when handling system 100, a low profile wig head assembly 110 includes a plurality of low profile wig heads 111, such as is shown by way of example in FIG. 5. For purposes of clarity, the wide variety of wigs which may utilize the present low profile wig handling system 100 are not shown in the figures, however, it is to be appreciated that the wigs which may utilize the present invention include a net or cap which comes into contact with a wearer's head and have different arrangements of real or synthetic hair attached to the net or cap. Is to be further appreciated that wigs come in different shapes and sizes having a wide variety of predefined internal configurations to be fitted onto an equally wide variety of different shapes and sizes of human heads. Each low profile wig head 111 in accordance with the present invention is adjustable between a plurality of adjustable wig head configurations 131 so as to approximate a predefined internal configuration of a particular wig to be retained thereon.

A low profile wig head 111 is at least partially defined by an upper portion 112 generally configured like a human head but having a low profile. As used herein, "low profile" shall mean having a dimension from side to side which is generally much narrower or thinner than a typical human head, the importance of which will be appreciated more from the following disclosure. In at least one embodiment, a low profile wig head 111 comprises a width ranging from about 50 millimeters to about 150 millimeters. A low profile wig head 111 is also at least partially defined by a lower portion 113 generally configured as a human neck, but again, having a lower. i.e., thinner, profile. In at least one embodiment, a low profile wig head 111 is further defined by a front portion 114, such as is shown by way of example in FIG. 1, and a rear portion 115, such as is shown by way of example in FIG. 2.

Figure 3:
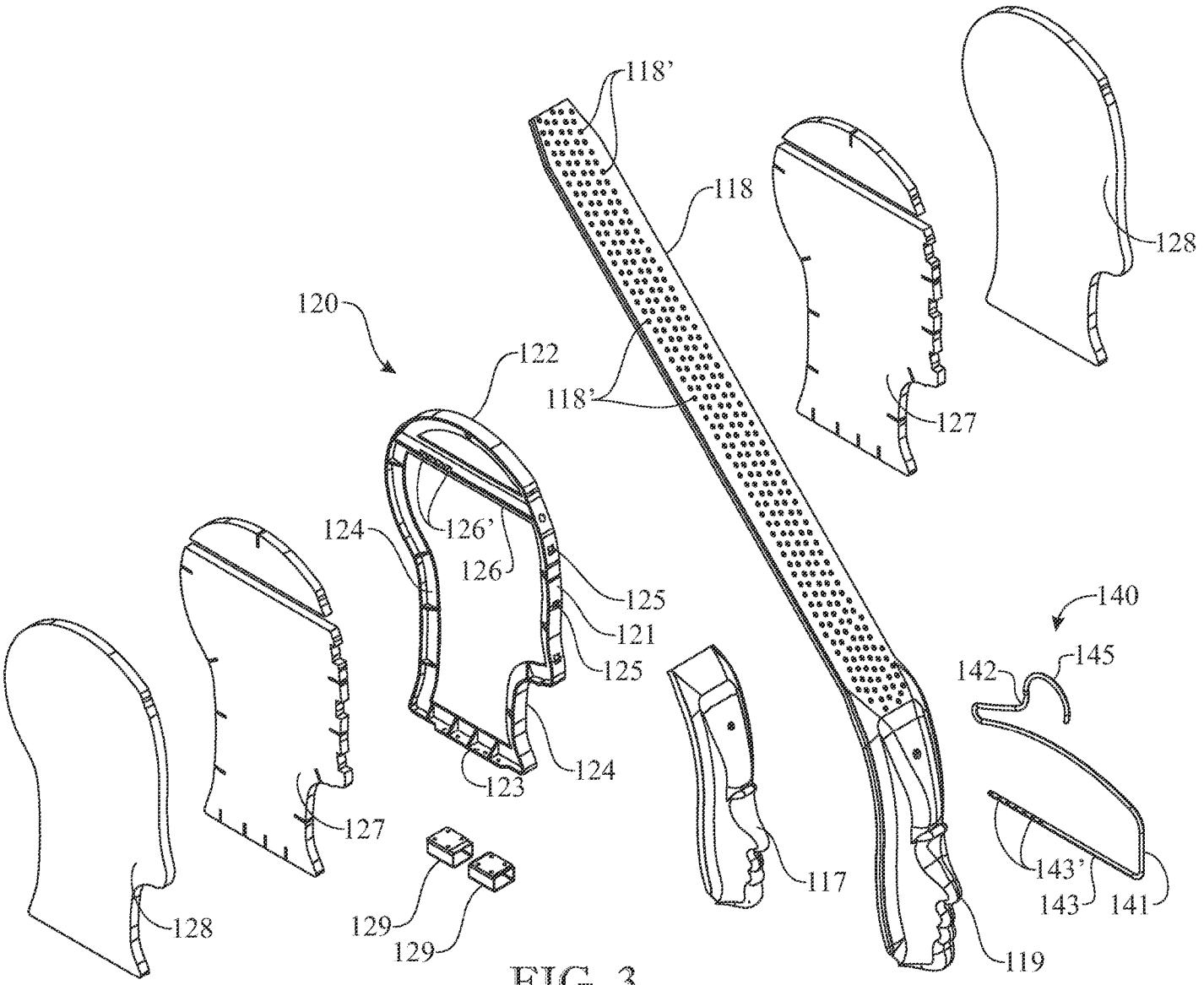
FIG. 3 presents a partially exploded view of one illustrative embodiment of a frame assembly and a support assembly of a low profile wig handling system, in accordance with the present invention.

A low profile wig head 111 in accordance with the present invention further comprises a face member 117 such as is shown best in FIG. 3. As may be seen from FIG. 3, a face member 117 in at least one embodiment includes several facial features including eyes, a nose, a mouth and a chin at least generally resembling that of a human face. In at least one embodiment, a face member 117 is attached to a central frame member 121 of the frame assembly 120, as discussed in greater detail hereinafter, via a plurality of clips or tabs (not shown) which engage a corresponding plurality of face member interconnects 125 formed in a forward portion of the central frame member 121. A face cover 119 is provided in at least one embodiment and is disposed in an overlying relation to the face member 117.

Each low profile wig head 111 of the low profile wig head assembly 110 in accordance with the present invention further comprises a wig retainer 118 which is disposed over and along an upper portion 112 of each lower profile wig head 111. A wig retainer 118 is configured to engage each of the different ones of the wide variety of wigs having different shapes and sizes and, therefore, different predefined internal configurations, one at a time. More in particular, in at least one embodiment, the wig retainer 118 is constructed of a low durometer silicone material to provide adequate friction force or grip to engage the cap or net of a wig to be retained thereon. In one further embodiment, a wig retainer 118 includes a plurality of wig retention members 118' to further facilitate engaging the cap or net of a wig to be retained thereon. Similar to a wig retainer 118 itself, one or more of a plurality of wig retention members 118' may be constructed of a low durometer silicone material, once again, to provide adequate friction force or grip to engage the cap or net of a wig to be retained thereon. As may be seen best in FIGS. 1 and 2, in at least one embodiment, a wig retainer 118 comprises a plurality of wig retention members 118' arranged on the wig retainer 118 in a wig retention array to further facilitate engaging the cap or net of a wig to be retained thereon.

A low profile wig head 111 in accordance with the present invention is formed around a frame assembly 120. A frame assembly 120 includes a central frame member 121 which is constructed of a rigid material such as by way of example wood, metal, plastic, fiberglass, etc. In at least one embodiment, a central frame number 121 is constructed of an acrylonitrile butadiene styrene plastic polymer, more commonly known as ABS. FIG. 3 presents a partially exploded view of one illustrative embodiment of a frame assembly 120 in accordance with the present invention. As may be seen from FIG. 3, the frame assembly 120 includes a central frame member 121 which is generally configured in the shape of a profile of a human head. As further shown in FIG. 3, the central frame member 121 is at least partially defined by a top 122, a bottom 123 and oppositely disposed sides 124. In at least one embodiment, a central frame member 121 of the frame assembly 120 includes at least one face member interconnect 125 disposed along the front portion thereof. As disclosed above, a face member 117 includes one or more clips or tabs (not shown) which are dimensioned and configured to engage at least one face member interconnect 125 of a central frame member 121. With continued reference to FIG. 3, a central frame member 121 includes a plurality of face member interconnects 125 arranged along a front portion thereof each dimensioned and configured to engage a corresponding plurality of clips or tabs (not shown) of the face member 117 so as to secure the face member 117 to the central frame member 121, in accordance with at least one embodiment of the present invention. A face member 117 may be constructed from any of a variety of materials of construction including foam, rubber, plastic, fiberglass, etc., having sufficient rigidity to retain the facial features formed thereon. In at least one embodiment, a face member 117 is constructed of an acrylonitrile butadiene styrene plastic polymer, similar to the central frame number 121.

A central frame member 121 of a frame assembly 120 further comprises a support member interconnect 126. With reference once again to FIG. 3, a central frame member 121 includes a support member interconnect 126 comprising an at least partially hollow channel dimensioned and configured to receive a hanger-frame interconnect 143 or a stand-frame interconnect 147 therein, each being discussed in greater detail hereinafter. A support member interconnect 126 in at least one embodiment includes at least one detent 126' dimensioned and configured to receive a corresponding tab of a hanger-frame interconnect 143 or a stand-frame interconnect 147 to secure a hanger member 142 or a stand member 146 therein, as is also discussed in greater detail below, to the central frame member 121. A support member interconnect 126 in at least one embodiment includes a plurality of detents 126' each dimensioned and configured to receive a corresponding one of a plurality of tabs 143' of a hanger-frame interconnect 143 of a hanger member 142, as is shown best in the illustrative embodiment of FIG. 3.

A frame assembly 120 in accordance with at least one embodiment of the present invention includes at least one side frame member mounted to one side 124 of the central frame member 121. In another embodiment, a frame assembly 120 includes at least one side frame member mounted to each opposite side 124 of the central frame member 121. With reference once again to FIG. 3, in at least one further embodiment, a frame assembly 120 includes a plurality of side frame members, and more in particular, an inner side frame member 127 and an outer side frame member 128, mounted to each opposite side 124 of the central frame member 121. An inner side frame member 127 and an outer side frame member 128 in accordance with the present invention may be constructed of any of a variety of materials including cloth, foam, metal, plastic, fiberglass, etc. In at least one embodiment, an inner side frame member 127 and an outer side frame member 128 are constructed of a high density polyurethane foam material. As will be appreciated, each of the inner side frame members 127 and outer side frame members 128 may be mounted to the corresponding sides 124 of a central frame member 121 by any variety of mechanical fasteners, sewing, adhesives, etc. In at least one embodiment, each of the outer side frame members 128 is bonded to a corresponding side 124 of the central frame member 121 via an adhesive, and each of the inner side frame members 127 is bonded to a corresponding one of the outer side frame members 128 via an adhesive as well. Alternatively, an inner side frame number 127 and an outer side frame member 128 may comprise an integral construction with one another, and the integrally constructed side frame members 127, 128 are bonded to corresponding sides 124 of the central frame member 121 via an adhesive.

A low profile wig head 111 in accordance with at least one embodiment of the present invention further comprises a head encasement 116 which is dimensioned and configured to be disposed over the frame assembly 120 in a surrounding relation. More in the particular, after each of inner side frame members 127 and/or outer side frame members 128 are mounted to a central frame member 121, and, if included, a face member 117 is secured to the central frame member 121, a head encasement 116 is dimensioned and configured to be disposed over the frame assembly 120 in a tight fitting surrounding relation thereto, such as is shown best in the illustrative embodiments of FIGS. 1 and 2. It will be appreciated that a head encasement 116 may be secured over a frame assembly 120 any number of ways including, but not limited to, mechanical fasteners, sewing, adhesives, etc. At least one embodiment, a head encasement 116 is constructed of a semi-rigid fabric material which is secured over a frame member 120 by sewing.

Figure 5:
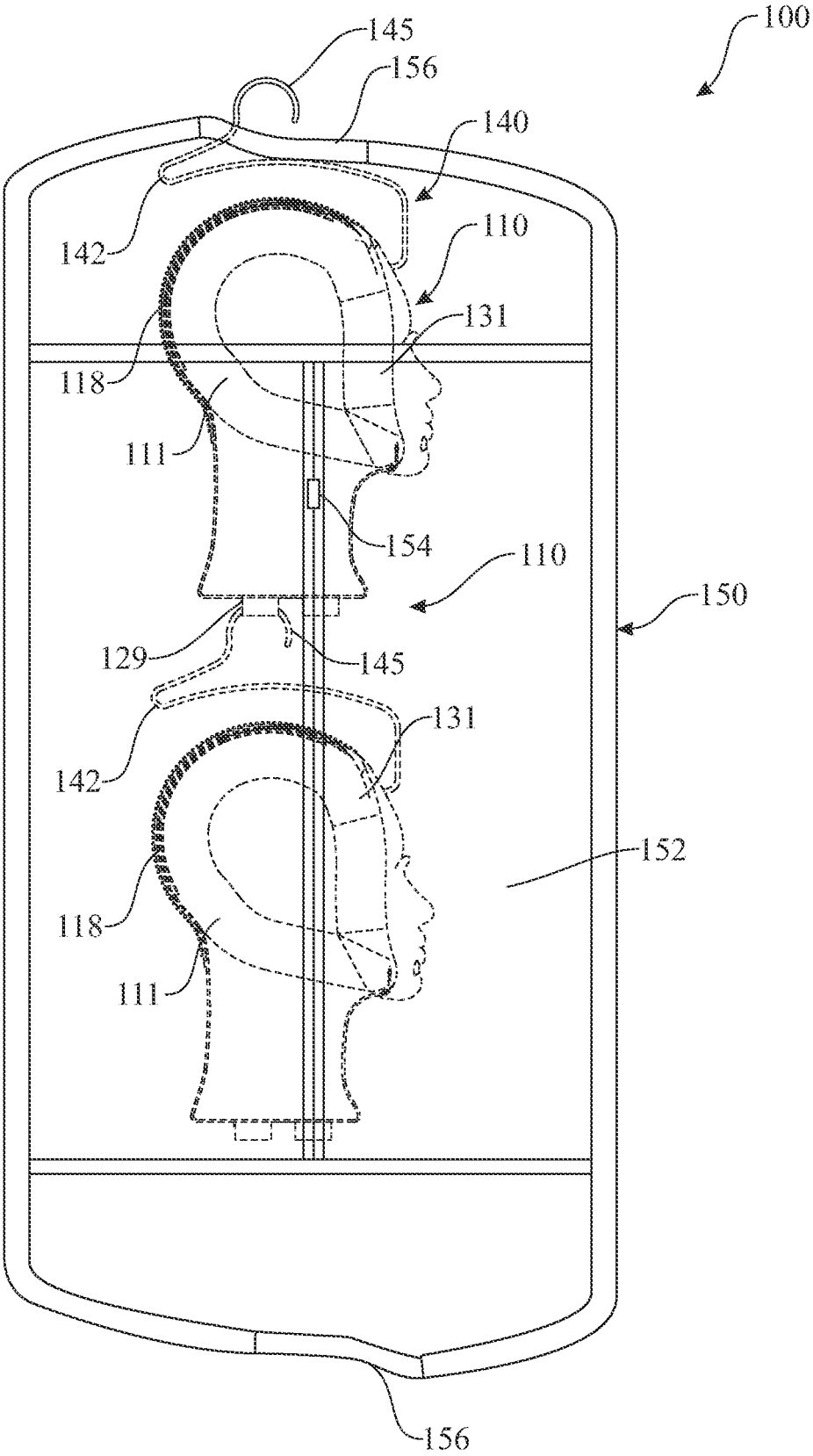
FIG. 5 presents an elevation of one illustrative embodiment of a plurality of low profile wig heads operatively disposed in a transport assembly of a low profile wig handling system, in accordance with the present invention.

A frame assembly 120 in at least one embodiment includes at least one interconnect loop 129 attached thereto. More in particular, an interconnect loop 129 is provided to allow a plurality of low profile wig heads 111 of a low profile wig head assembly 110 to be temporarily interconnected to one another to facilitate storage and/or transport thereof. With reference once again to FIG. 3, in at least one embodiment, a frame assembly 120 comprises a plurality of interconnect loops 129. An interconnect loop 129 in accordance with the present invention may be constructed from any of a number of materials including, but not limited to, wood, metal, plastic, fiberglass, cloth, etc., and may be attached to a frame assembly 120 by any variety of attachment mechanisms, including at least mechanical fasteners, sewing, adhesives, etc. In accordance with at least one embodiment of the present invention, a frame assembly 120 includes a plurality of interconnect loops 129 which are constructed of cloth and are attached to a head encasement 116 surrounding the frame assembly 120 proximate a bottom 123 of a central frame member 121 by sewing each interconnect loop 129 to a portion of the head encasement 116. With reference to FIG. 5, one illustrative embodiment of a plurality of low profile wig heads Ill interconnected to one another by way of an interconnect loop 129 is presented.

A low profile wig handling system 100 in accordance with the present invention further comprises a wig head adjustment assembly 130. A wig head adjustment assembly 130 permits adjustment of a low profile wig head 111 between a plurality of adjustable wig head configurations 131. More in particular, a low profile wig head 111 in accordance with the present invention is adjustable between a plurality of adjustable wig head configurations 131 wherein each of the plurality of adjustable wig head configurations 131 of a low profile wig head 111 includes a different width and/or a different girth. As stated above, in at least one embodiment, a low profile wig head 111 comprises a width ranging from about 50 millimeters to about 150 millimeters. As will be appreciated, such a width is considerably less than that of a traditional static STYROFOAM® or plastic wig head, such that the present low profile wig handling system 100 provides considerable convenience and requires less space to store and/or transport a plurality of wigs having any of a number of wig configurations. Stated otherwise, by providing a low profile wig head 111 which is adjustable between a plurality of adjustable wig head configurations 131, the present low profile wig handling system 100 allows a user to store and/or transport a greater number of wigs more efficiently and in considerably less space.

A wig head adjustment assembly 130 includes at least one adjustable wig head compartment 132 attached proximate at least one side of a frame assembly 120. In at least one embodiment, a wig head adjustment assembly 130 includes a plurality of adjustable wig head compartments 132 each attached proximate opposite sides of a frame assembly 120, such as is shown best in FIGS. 1 and 2. As before, any of a number of attachment mechanisms may be utilized to attach each adjustable wig head compartment 132 proximate the opposite sides of a frame assembly 120 including at least mechanical fasteners, sewing, adhesives, etc. In at least one embodiment, each adjustable wig head compartment 132 is attached proximate a corresponding opposite side of a frame assembly 120 by sewing each adjustable wig head compartment 132 to portions of a head encasement 116 along opposite sides of the frame assembly 120.

An adjustable wig head compartment 132 in accordance with the present invention includes an inner compartment 133 dimensioned and configured to receive at least one adjustment member therein. An adjustable wig head compartment 132 in at least one embodiment includes a compartment closure 134 which may be opened or closed to insert or remove one or more adjustment members from the inner compartment 133 thereof, respectively. In at least one further embodiment, a compartment closure 134 includes a hidden zipper configuration so as to prevent the zipper mechanism from becoming entangled with a wig retained on a low profile wig head 111 in accordance with the present invention.

An adjustable wig head compartment 132 in accordance with the present invention may be constructed from any of a number of materials including cloth, rubber, vinyl, etc. In at least one embodiment, the material of construction of an adjustable wig head compartment 132 provides at least some resilience in order to accommodate the insertion or removal of one or more adjustment members therefrom. In at least one further embodiment, an adjustable wig head compartment 132 is constructed of a polyether-polyurea copolymer which is more commonly known as elastine or spandex, such as is manufactured and sold under the brand name LYCRA® by The Lycra Company of Wilmington, Delaware.

Figure 4:
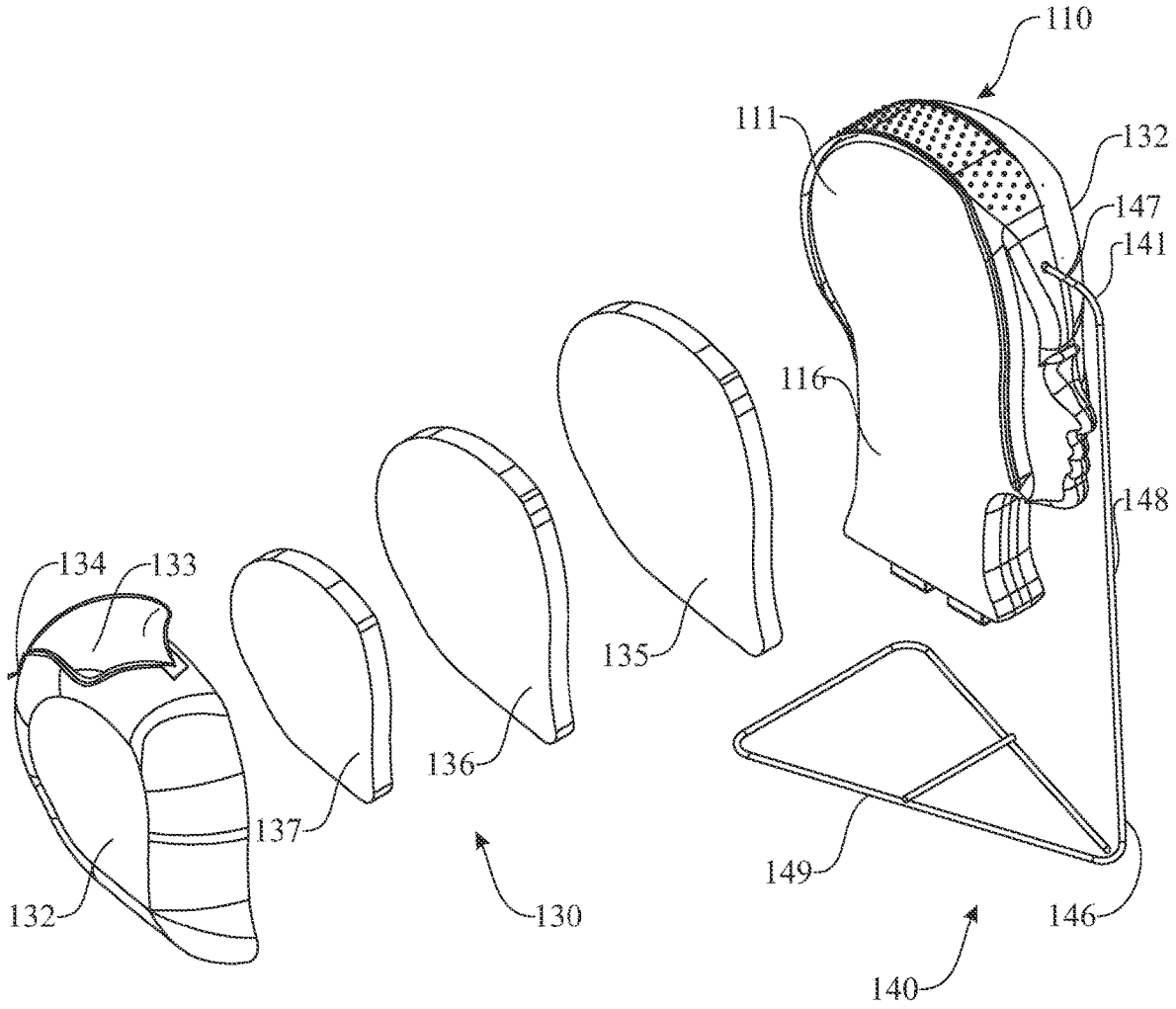
FIG. 4 presents a partially exploded view of one illustrative embodiment of wig head adjustment assembly proximate a low profile wig head assembly of a low profile wig handling system, in accordance with the present invention.

A wig head adjustment assembly 130 in at least one embodiment includes a plurality of adjustment members. More in particular, a wig head adjustment assembly 130 may include a primary adjustment member 135, a secondary adjustment member 136, a tertiary adjustment member 137, and so on. FIG. 4 presents a partially exploded view of one illustrative embodiment of a wig head adjustment assembly 130 in accordance with the present invention. As may be seen from FIG. 4, the adjustment members 135, 136, 137, comprise diminishing dimensions relative to one another with the primary adjustment member 135 comprising the greatest overall dimension and the tertiary adjustment member 137 comprising the least overall dimension. As will be appreciated, a user may mix-and-match the plurality of adjustment members 135, 136, 137, to be operatively positioned within an inner compartment 133 of an adjustable wig head compartment 132 to permit a low profile wig head 111 to be adjustable between any of a plurality of adjustable wig head configurations 131. It is to be appreciated that the plurality of adjustment members 135, 136, 137, in accordance with the present invention may be constructed from any of a number of materials including plastic, foam, rubber, cloth, etc. In at least one embodiment, each of the plurality of primary adjustment member 135, a secondary adjustment member 136, a tertiary adjustment member 137 are constructed of a medium density polyurethane foam.

As disclosed above, in at least one embodiment, a low profile wig handling system 100 in accordance with the present invention includes a support assembly 140. More in particular, a support assembly 140 includes at least one support member 141 to facilitate supporting a low profile wig head 111 having a wig retained thereon from an elevated member, such as by hanging for storage and/or transport, or upon an underlying surface so as to facilitate access to the wig for preparation thereof prior to being worn by a person.

A support member 141 of a support assembly in at least one embodiment comprises a hanger member 142, such as is shown best in FIG. 3. A hanger member 142 includes a hanger-frame interconnect 143, as previously discussed, dimensioned and configured to be received and releasably secured within a support member interconnect 126 of a central frame member 121 of a frame assembly 120. In at least one embodiment, a hanger-frame interconnect 143 comprises an elongated configuration, such as is shown best in the illustrative embodiment of FIG. 3. In at least one embodiment, a hanger-frame interconnect 143 includes at least one tab 143' which is dimensioned and configured to be received in a detent 126' in a support member interconnect 126 of a central frame member 121. In at least one further embodiment, a hanger-frame interconnect 143 includes a plurality of tabs 143', as shown in FIG. 3, each of which is dimensioned and configured to be received in a corresponding one of a plurality of detents 126' in a support member interconnect 126 of a central frame member 121, as also shown in FIG. 3. More in particular, each of the plurality of tabs 143' of the hanger-frame interconnect 143 are received in a corresponding one of a plurality of detents 126' in a support member interconnect 126 of a central frame member 121 to releasably secure the hanger member 142 to the central frame member 121, and thus, to the low profile wig head 111 itself.

As shown throughout the figures, a hanger member 142 in accordance with the present invention further comprises a hanger support arm 144 connected between a hanger-frame interconnect 143 on one end and a hook 145 on the opposite end thereof. The hook 145 is dimensioned and configured to permit a low profile wig head 111 having a wig retained thereon to be supported in an upright orientation from an elevated member such as a closet rod, a shower curtain rod, a travel hook in a car or van, etc., just to name a few. In at least one embodiment, a hook 145 of a hanger member 142 permits a plurality of low profile wig heads 111, each having a wig retained thereon, to be interconnected to one another via an interconnect loop 129, such as is shown best, once again, in FIG. 5.

A support member 141 of a support assembly in at least one further embodiment comprises a stand member 146. Similar to a hanger member 142, a stand member 146 includes a stand-frame interconnect 147 dimensioned and configured to be received and retained within a support member interconnect 126 of a central frame member 121 of a frame assembly 120. Also similar to a hanger member 142, a stand-frame interconnect 147 may include one or more tabs (not shown) dimensioned and configured to be received in a corresponding detent 126' in a support member interconnect 126 of a central frame member 121 so as to releasably secure a low profile wig head 111 to a stand member 146 to facilitate preparation of the wig prior to being worn by a person. More in particular, a stand member 146 includes a stand support arm 148 attached between a stand-frame interconnect 147 and a base 149, as shown best in FIG. 4, thereby supporting a low profile wig head 111 in an operative upright orientation on an underlying supporting surface, so as to facilitate preparation for use thereof.

A low profile wig handling system 100 in accordance with at least one embodiment of the present invention further comprises a transport assembly 150. With reference to FIG. 5, a transport assembly 150 includes a transport cover 152 which is dimensioned and configured to overly a plurality of low profile wig heads 111, each having a having a corresponding plurality of wigs (not shown for purposes of clarity) retained thereon in an upright orientation. In one embodiment, a transport cover 152 includes a transport cover closure 154 to permit access into the interior of the transport cover 152 to place or remove one or more low profile wig head 111 having a wig retained thereon into or out of the transport cover 152, respectively. As will be appreciated, a transport cover 152 may be constructed form any of a plurality of materials which may be rigid, semi-rigid or pliable. In at least one embodiment, a transport cover 152 is constructed of a breathable material so as to minimize static build-up on the wigs being stored and/or transported while therein.

A transport cover 152 in one embodiment includes at least one hanger aperture 156 formed through one end thereof to permit a hook 145 of a hanger member 142 to pass therethrough so as to facilitate hanging a plurality of low profile wig heads 111, each having a wig retained thereon, in an upright orientation from an elevated member while remaining secured in the interior of the transport cover 152. In one further embodiment, a transport cover 152 includes a plurality of hanger apertures 156 disposed through oppositely disposed ends thereof, thereby allowing the transport cover 152 to be utilized in either orientation.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A low profile wig handling system allows a user to securely store, transport and prepare at least one wig having a predefined internal configuration, said system comprising:

a low profile wig assembly having at least one low profile wig head which is adjustable between a plurality of adjustable wig head configurations;

a wig retainer disposed on an upper portion of said at least one low profile wig head, said wig retainer constructed of a low durometer silicone material to provide friction forces to engage and retain the at least one wig thereon;

said at least one low profile wig head comprising a frame assembly including a central frame member having a support member interconnect;

said at least one low profile wig head further comprising a wig head adjustment assembly having at least one adjustment member constructed of a resilient medium density polyurethane foam to permit adjustment of said at least one low profile wig head between said plurality of adjustable wig head configurations;

a support assembly having at least one support member operable with said central frame member to maintain said at least one low profile wig head, and the at least one wig retained thereon, in an operative upright orientation; and a transport assembly comprising a transport cover dimensioned and configured to receive the at least one wig securely retained on said at least one low profile wig head therein.

2. The low profile wig handling system as recited in claim 1, wherein said at least one low profile wig head has a front portion and a rear portion.

3. The low profile wig handling system as recited in claim 2, wherein said at least one low profile wig head includes a face member mounted on said front portion thereof.

4. The low profile wig handling system as recited in claim 1, wherein said wig retainer comprises a plurality of wig retention members.

5. The low profile wig handling system as recited in claim 4, wherein said plurality of wig retention members are arranged on said wig retainer in a wig retention array.

6. The low profile wig handling system as recited in claim 1, wherein said frame assembly further comprises at least one side frame member mounted to said central frame member.

7. The low profile wig handling system as recited in claim 1, wherein said frame assembly further comprises a plurality of side frame members mounted to said central frame member.

8. The low profile wig handling system as recited in claim 7, wherein said plurality of side frame members include at least one inner side frame member and at least one outer side frame member.

9. The low profile wig handling system as recited in claim 1, wherein said at least one low profile wig head comprises a head encasement dimensioned and configured to be disposed over said frame assembly in a surrounding relation thereto.

10. The low profile wig handling system as recited in claim 8, wherein said at least one low profile wig head comprises a head encasement dimensioned and configured to be disposed over said frame assembly in a surrounding relation thereto.

11. The low profile wig handling system as recited in claim 1, wherein said wig head adjustment assembly comprises at least one adjustable wig head compartment attached adjacent one side of said frame assembly, said at least one adjustable wig head compartment dimensioned and configured to receive said at least one adjustment member therein to permit adjustment of said at least one low profile wig head to one of said plurality of adjustable wig head configurations which approximates the predefined internal configuration of the at least one wig retained thereon.

12. The low profile wig handling system as recited in claim 1, wherein said wig head adjustment assembly comprises a plurality of adjustment members.

13. The low profile wig handling system as recited in claim 1, wherein said wig head adjustment assembly comprises a plurality of adjustable wig head compartments each attached adjacent an opposite side of said frame assembly, each of said plurality of adjustable wig head compartments dimensioned and configured to receive said at least one adjustment member therein to permit adjustment of said at least one low profile wig head to one of said plurality of adjustable wig head configurations which approximates the predefined internal configuration of the at least one wig retained thereon.

14. The low profile wig handling system as recited in claim 12, wherein said wig head adjustment assembly comprises a plurality of adjustable wig head compartments each attached adjacent an opposite side of said frame assembly, each of said plurality of adjustable wig head compartments dimensioned and configured to receive at least some of said plurality of adjustment members therein to permit adjustment of said at least one low profile wig head to one of said plurality of adjustable wig head configurations which approximates the predefined internal configuration of the at least one wig retained thereon.

15. The low profile wig handling system as recited in claim 1, wherein said support member comprises a hanger member having a hook to facilitate supporting said at least one low profile wig head having the at least one wig retained thereon from an elevated member.

16. The low profile wig handling system as recited in claim 1, wherein said support member comprises a stand member having a base to facilitate supporting said at least one low profile wig head having the at least one wig retained thereon on an underlying surface.

17. A low profile wig handling system allows a user to store, transport and prepare a plurality of wigs each having one of a plurality of predefined internal configurations, said system comprising:

a low profile wig assembly having a plurality of low profile wig heads each adjustable between a plurality of adjustable wig head configurations;

a wig retainer disposed on an upper portion of each of said plurality of low profile wig heads, each said wig retainer constructed of a low durometer silicone material to provide friction forces to engage and retain at least one of the plurality of wigs thereon;

each of said plurality of low profile wig heads comprising a frame assembly including a central frame member having a support member interconnect;

each of said plurality of low profile wig heads further comprising a wig head adjustment assembly having a plurality of adjustment members each constructed of a resilient medium density polyurethane foam and a plurality of adjustable wig head compartments each attached adjacent opposite sides of said frame assembly, each of said plurality of adjustable wig head compartments dimensioned and configured to receive at least some of said plurality of adjustment members therein to permit adjustment of each of said plurality of low profile wig heads to one of said plurality of adjustable wig head configurations which approximates the predefined internal configuration of a corresponding one of the plurality of wigs retained thereon;

a support assembly having at least one support member operable with said central frame member to maintain said at least one low profile wig head, and the at least one wig retained thereon, in an operative upright orientation; and a transport assembly comprising a transport cover dimensioned and configured to receive the plurality of wigs each securely retained on a corresponding one of said plurality of low profile wig heads therein.

18. The low profile wig handling system as recited in claim 17, wherein said support member comprises a hanger member having a hook to facilitate supporting each of said plurality of low profile wig heads each having a corresponding one of the plurality of wigs retained thereon from an elevated member.

19. The low profile wig handling system as recited in claim 17, wherein said support member comprises a stand member having a base to facilitate supporting at least one of said plurality of low profile wig heads having a corresponding one of the plurality of wigs retained thereon on an underlying surface.

20. A low profile wig handling system allows a user to store, transport and prepare a plurality of wigs each having one of a plurality of predefined internal configurations, said system comprising:

a low profile wig assembly having a plurality of low profile wig heads each adjustable between a plurality of adjustable wig head configurations;

a wig retainer disposed on an upper portion of each of said plurality of low profile wig heads, each said wig retainer constructed of a low durometer silicone material to provide friction forces to engage and retain at least one of the plurality of wigs thereon;

each of said plurality of low profile wig heads comprising a frame assembly including a central frame member having a support member interconnect;

each said frame assembly further comprising a plurality of side frame members mounted to said central frame member;

each of said plurality of low profile wig heads further comprising a wig head adjustment assembly having a plurality of adjustment members each constructed of a resilient medium density polyurethane foam and including at least a primary adjustment member, a secondary adjustment member and a tertiary adjustment member, and a plurality of adjustable wig head compartments each attached adjacent opposite sides of said frame assembly, each of said plurality of adjustable wig head compartments dimensioned and configured to receive at least some of said plurality of adjustment members therein to permit adjustment of each of said plurality of low profile wig heads to one of said plurality of adjustable wig head configurations which approximates the predefined internal configuration of a corresponding one of the plurality of wigs retained thereon;

a support assembly having at least one support member operable with said central frame member to maintain said at least one low profile wig head, and the at least one wig retained thereon, in an operative upright orientation; and a transport assembly comprising a transport cover dimensioned and configured to receive the plurality of wigs each securely retained on a corresponding one of said plurality of low profile wig heads therein.

* * * * *